US006797148B2

(12) United States Patent
De Nora

(10) Patent No.: US 6,797,148 B2
(45) Date of Patent: Sep. 28, 2004

(54) DRAINED-CATHODE ALUMINIUM ELECTROWINNING CELL WITH IMPROVED ELECTROLYTE CIRCULATION

(75) Inventor: Vittorio De Nora, Nassau (BS)

(73) Assignee: Moltech Invent S.A. (LU)

( * ) Notice: Subject to any disclaimer, the term of this patent is extended or adjusted under 35 U.S.C. 154(b) by 0 days.

(21) Appl. No.: 10/133,224

(22) Filed: Apr. 27, 2002

(65) Prior Publication Data

US 2002/0166775 A1 Nov. 14, 2002

Related U.S. Application Data

(63) Continuation-in-part of application No. PCT/IB00/01552, filed on Oct. 25, 2000, and a continuation-in-part of application No. PCT/IB99/01740, filed on Oct. 26, 1999.

(51) Int. Cl.[7] ..... C25C 3/06; C25C 3/08; C25C 3/00; C25B 11/00

(52) U.S. Cl. ..... 205/376; 205/381; 205/392; 204/244; 204/245; 204/246; 204/247; 204/284

(58) Field of Search ..... 205/376, 381, 205/392; 204/244–247, 284, 243.1

(56) References Cited

U.S. PATENT DOCUMENTS 4,462,886 A * 7/1984 Kugler ..... 204/284
5,368,702 A * 11/1994 de Nora ..... 204/247 X
5,725,744 A * 3/1998 de Nora et al. ..... 204/244

* cited by examiner

*Primary Examiner*—Donald R. Valentine
(74) *Attorney, Agent, or Firm*—Jayadeep R. Deshmukh

(57) ABSTRACT

A drained-cathode cell for the electrowinning of aluminium comprises one or more anodes (14) suspended over one or more cathodes (16). The or each anode (14) and cathode (16) respectively have a sloped V-shaped active anode surface (22) and parallel sloped inverted V-shaped drained cathode surfaces (18) facing one another and spaced apart by two sloped inter-electrode gaps (20), arranged so the electrolyte circulates upwardly in the sloped inter-electrode gaps (20) assisted by anodically produced gas and then returns from a top part (22') to a bottom part (22") of each inter-electrode gap (20) along an electrolyte path (26,27,36,37). Each electrolyte path (26,27,36,37) extends through vertical and horizontal passages as follow: a vertical passage (27) from a top to a lower part of a cathode (16) and then a horizontal passage (26) in or under the lower part of the cathode (26), and/or a horizontal passage (36) in or on an upper part of an anode (14) and then a vertical passage (37) extending from the upper to a bottom part of the anode (14). Each horizontal passage (26,36) extends substantially over the entire horizontal length of a corresponding inter-electrode gap (20).

27 Claims, 5 Drawing Sheets

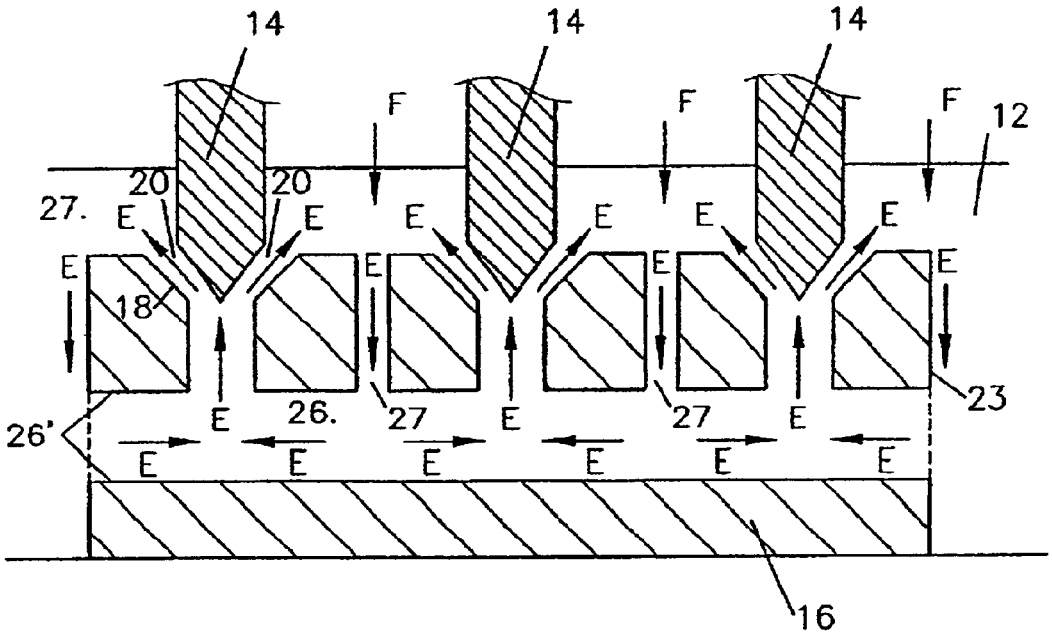
14
14
14
F
F
F
12
20
20
27.
E
E
E
E
E
E
E
E
E
E
18
E
E
E
E
E
E
E
E
E
E

DRAINED-CATHODE ALUMINIUM ELECTROWINNING CELL WITH IMPROVED ELECTROLYTE CIRCULATION

This Application is a Continution-in-part (CIP) of prior application No. PCT/IB00/01552 filed Oct. 25, 2000 which is a Continuation-in-part (CIP) of prior application No. PCT/IB99/01740 filed Oct. 26, 1999.

FIELD OF THE INVENTION

The invention relates to drained-cathode cells for the electrowinning of aluminium from alumina, of the type comprising a series of anodes spaced by a sloped inter-electrode gap from one or more facing cathodes and arranged so the electrolyte circulates upwardly in the sloped inter-electrode gap assisted by anodically produced gases. The invention also relates to a method of producing aluminium in such cells as well as to cathodes and anodes designed for such cells.

BACKGROUND OF THE INVENTION

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

U.S. Pat. No. 3,400,061 (Lewis/Hildebrandt) and U.S. Pat. No. 4,602,990 (Boxall/Gamson/Green/Traugott) disclose aluminium electrowinning cells with sloped drained cathodes and facing anodes sloping across the cell. In these cells, the molten aluminium flows down the sloping cathodes into a median longitudinal groove along the center of the cell, or into lateral longitudinal grooves along the cell sides, for collecting the molten aluminium and delivering it to a sump.

In U.S. Pat. No. 5,362,366 (de Nora/Sekhar), a double-polar anode-cathode arrangement was disclosed wherein cathode bodies were suspended from the anodes permitting removal and reimmersion of the assembly during operation, such assembly also operating with a drained cathode.

U.S. Pat. No. 5,368,702 (de Nora) proposed a novel multimonopolar cell having upwardly extending cathodes facing and surrounded by or in-between anodes having a relatively large inwardly-facing active anode surface area. In some embodiments, electrolyte circulation was achieved using a tubular anode with suitable openings.

U.S. Pat. No. 5,651,874 (de Nora/Sekhar) proposed coating components with a slurry-applied coating of refractory boride, which proved excellent for cathode applications. This publication discloses slurry-applied applications and novel drained cathode configurations, including designs where a cathode body with an inclined upper drained cathode surface is placed on or secured to the cell bottom.

U.S. Pat. No. 5,683,559 (de Nora) proposed a new cathode design for a drained cathode, where grooves or recesses were incorporated in the surface of blocks forming the cathode surface in order to channel the drained product aluminium.

Recently it has become possible to coat carbon cathodes with a slurry which adheres to the carbon and becomes aluminium-wettable and very hard when the temperature reaches 700–800° C. or even 950–1000° C., as mentioned above. Though application of these coatings to drained cathode cells has been proposed, so far the commercial-scale application of this technology has been confined to coating carbon bottoms of cells operating with the conventional deep pool of aluminium. Further design modifications in the cell construction could lead to obtaining more of the potential advantages of these coatings.

While the foregoing references indicate continued efforts to improve cell operations, none suggests the invention and there have been no acceptable proposals for improving the cell efficiency, and at the same time facilitating the implementation of a drained cathode configuration with improved electrolyte circulation.

OBJECTS OF THE INVENTION

An object of the invention is to overcome problems inherent in the conventional design of cells used in the electrowinning of aluminium from alumina dissolved in molten fluoride-containing melts in particular cryolite, notably by proposing a drained cathode configuration incorporating an improved electrode arrangement.

Another object of the invention is to permit more efficient cell operation by modifying the design of the drained cathode(s) and/or of the anodes to improve the electrolyte circulation.

Yet another object of the invention is to provide an arrangement wherein gas release at a sloping anode surface is used to induce electrolyte circulation which in turn is facilitated by a novel cathode and/or anode design.

A further object of the invention is to provide a cell with a cathode of novel design enabling drained cathode operation where efficient electrolyte circulation is combined with ease of removal of the anodically produced gases and with ease of collection of the product aluminium.

A yet further object of the invention is to enhance the efficiency of electrolysis by supplying alumina to a circulating electrolyte to compensate for depletion during electrolysis, this electrolyte circulation being produced by means of a novel electrode configuration.

SUMMARY OF THE INVENTION

One main aspect of the invention concerns a drained-cathode cell for the electrowinning of aluminium from alumina dissolved in a fluoride-containing molten electrolyte. The cell comprises one or more anodes and one or more cathodes. The or each anode and cathode respectively have a sloped V-shaped active anode surface and parallel sloped inverted V-shaped drained cathode surface facing one another and spaced apart by two sloped inter-electrode gaps, arranged so that the electrolyte circulates upwardly in the sloped inter-electrode gaps assisted by anodically produced gas and then returns from a top part to a bottom part of each inter-electrode gap along an electrolyte path. Each electrolyte path extends through vertical and horizontal passages as follows: for the cathode, a vertical passage from a top to a lower part of a cathode and then a horizontal passage in or under the lower part of the cathode; and/or for the anode, a horizontal passage in or on an upper part of an anode and then a vertical passage extending from the upper to a bottom part of the anode. Each horizontal passage extends substantially over the entire horizontal length of a corresponding inter-electrode gap.

In this context, a "V-shaped surface" means a surface having a perpendicular cross-section which strictly or generally forms a V, in particular a flattened and/or truncated V. Such a surface may be generally conical, frusto-conical or bi-planar.

The drained-cathode cell according to the invention and the corresponding method of electrowinning aluminium have numerous advantages, including the following a) The anodically produced gases are rapidly removed due to the slope of the anodic active surfaces.

b) The cell can be operated at high current density, providing for a sufficient upward removal of anodically produced gas to produce a corresponding upward circulation of the electrolyte in the anode-cathode gap.

c) The slope of the cathodic surfaces is sufficient to allow for efficient draining of the product aluminium, despite the counter-current of electrolyte entrained upwardly by the gas release.

d) The generally horizontal passage provides part of a return path for the electrolyte, enabling a steady-state circulation of the electrolyte around the electrodes.

e) An improved electrolyte circulation may be achieved by providing a plurality of return paths associated with both anodic and cathodic electrodes.

e) The induced electrolyte circulation can advantageously be combined with a supply of alumina to compensate for depletion during electrolysis. This supply of alumina may be adjacent to the upper end of the sloping inter-electrode gap or possibly over the anodes.

f) The cathode(s) can easily be made from the usual grades of carbon used for cathode applications, the sloping cathodic surfaces at least being coated with a suitable coating of aluminium-wettable refractory material, for example a slurry-applied coating containing titanium diboride, for example as described in U.S. Pat. No. 5,651,874 (de Nora/Sekhar) or WO 98/17842 (Sekhar/Duruz/Liu).

g) Making the cathodes with generally conical, wedge-shaped or prismatic recesses in the cathodic top face leads to a very compact and energy-efficient design.

h) The cells can be used with consumable carbon anodes, but great advantages can be secured by using substantially dimensionally-stable non-carbon oxygen evolving anodes, particularly in conjunction with cathodes having generally conical, wedge-shaped or prismatic recesses in its/their top face.

i) The cathodes can be suspended from the anodes, for ease of removal and reinsertion in the cell.

Each horizontal passage of the electrolyte path may be formed by an aperture extending through a cathode or an anode.

The or each cathode may be associated with an electrolyte path. The electrolyte path may extend through a vertical passage in the middle of an inverted V-shaped cathode surface from the top to the lower part of the or each cathode. Alternatively, the electrolyte path may extend through a vertical passage extending from adjacent a top part of a V-shaped cathode surface to the lower part of the or each cathode.

Similarly, the or each anode may be associated with an electrolyte path. The electrolyte path may extend through a vertical passage from the upper to the bottom part of the or each anode in the middle of a V-shaped anode surface. Alternatively, the electrolyte path may extend through a vertical passage from the upper part of an inverted V-shaped anode surface to adjacent a bottom part of the anode.

The horizontal passages may be delimited by an external upper face of an anode or an external lower face of a cathode.

The sloped drained cathode surfaces may lead down into an arrangement for collecting product aluminium.

The or each cathode may be connected to at least one anode by connection means made of materials of high electrical, chemical and mechanical resistance maintaining the inter-electrode gaps substantially constant, such that the or each cathode is removable and insertable into the cell with the anode(s) to which it is connected. The or each cathode may be thus suspended from at least one anode, or suspended from an anode by other means. Alternatively, the or each cathode may be mechanically secured between a pair of adjacent anodes by at least one horizontal electrically non-conductive bar or rod which is secured in the pair of adjacent anodes and which extends though the cathode. The electrically non-conductive bar or rod can extend through a plurality of cathodes.

Usually, the drained cathode surfaces have an aluminium-wettable coating. Moreover, the drained cathode surfaces can be made dimensionally stable by a slurry-applied coating of aluminium-wettable refractory material.

The fluoride-containing molten electrolyte of the cell can be essentially cryolite or cryolite with an excess of $AlF_3$, typically an excess corresponding to about 25 to 35 weight % of the electrolyte. An excess of $AlF_3$ in the electrolyte reduces the melting point of the electrolyte and permits cell operation with an electrolyte at lower temperature, typically from 780° to 880° C., in particular from 820° to 860° C.

The invention also relates to a method of producing aluminium in a cell as described above which contains dissolved alumina in a molten electrolyte. The method comprises: electrolysing dissolved alumina in the inter-electrode gaps, thereby producing aluminium on the drained cathode surface(s) and gas on the active anode surface(s). The electrolyte circulation upwardly in the sloped inter-electrode gaps is assisted by the upward removal of anodically produced gas. The electrolyte is returned from a top part to a bottom part of the inter-electrode gaps along the electrolyte paths. Alumina-depleted electrolyte is replenished with alumina in the electrolyte paths, preferably adjacent to the top parts of the inter-electrode gaps.

When the anodes are made of carbon material, $CO_2$ is anodically produced during electrolysis.

Alternatively, the anodes are made of non-carbon inert material, preferably of metal or metal-based material, as for example disclosed in WO 99/36593, WO 99/36594, WO 00/06801, WO 00/06805 and WO 00/40783 (all in the name of de Nora/Duruz), U.S. Pat. No. 6,077,415 (Duruz/de Nora), WO 99/36591 and U.S. Pat. No. 6,103,090 (both in the name of de Nora). In a preferred embodiment, the anodes are made from a nickel-iron based alloy, e.g. as disclosed in WO 00/06803 (Duruz/de Nora/Crottaz) or WO 00/06804 (Crottaz/Duruz). When the anodes are made of inert material, oxygen is anodically evolved either by oxidising oxygen-containing ions directly on the active surfaces, or by firstly oxidising fluorine-containing ions that subsequently react with oxygen-containing ions, as described in PCT/IB99/01976 (Duruz/de Nora).

When the cell is operated with metal-based anodes, the molten electrolyte is advantageously substantially saturated with alumina, particularly on the electrochemically active anode surface, and with species of at least one major metal present at the surface of the anodes to maintain the anodes dimensionally stable, as disclosed in WO 00/06802 (Duruz/de Nora/Crottaz).

A "major metal" refers to a metal which is present at the surface of the anode, in particular in one or more oxide compounds, in an amount of at least 25% of the total amount of metal present at the surface of the anode.

The or each anode can be associated with an electrolyte path, alumina being fed from above the upper part of the or each anode where it is dissolved in the electrolyte and circulated along the electrolyte path to a lower part of the inter-electrode gap. Alternatively or cumulatively, the or each cathode can be associated with a electrolyte path, alumina being fed from above the top part of the or each cathode where it is dissolved in the electrolyte and circulated along the electrolyte path to a lower part of the inter-electrode gap.

Another aspect of the invention relates to a cathode of a cell for the electrowinning of aluminium from alumina dissolved in a molten fluoride-containing electrolyte as described above. The cathode comprises one or more inverted V-shaped sloped drained cathode surfaces facing during use one or more anodes and spaced therefrom by inter-electrode gaps. The cathode is associated with one or more electrolyte paths for the return of electrolyte from a top part to a bottom part of the inter-electrode gaps. The or each electrolyte path extends through a vertical passage from a top to a lower part of the cathode and then through a horizontal passage in or under the lower part of the cathode. The or each horizontal passage extends substantially over the entire horizontal length of the corresponding inverted V-shaped cathode surface.

A further aspect of the invention relates to an anode of a cell for the electrowinning of aluminium from alumina dissolved in a molten fluoride-containing electrolyte as described above. The anode comprises a V-shaped sloped active anode surface facing during use a correspondingly sloped drained cathode surface and spaced therefrom by inter-electrode gaps. The anode is associated with an electrolyte path for the return of electrolyte from a top part to a bottom part of the inter-electrode gaps. The electrolyte path extends through a horizontal passage in or on an upper part of the anode and then through a vertical passage extending from the upper part to a bottom part the anode. The horizontal passage extends substantially over the entire horizontal length of the V-shaped anode surface.

The invention relates also to a drained-cathode cell for the electrowinning of aluminium by the electrolysis of alumina dissolved in a fluoride-containing molten electrolyte. The cell comprises a series of anodes suspended over one or more cathodes. The anodes and the cathode(s) respectively have sloped active anode surfaces and parallel sloped drained cathode surfaces facing one another and spaced apart by sloped inter-electrode gaps, arranged so the electrolyte circulates upwardly in the sloped inter-electrode gaps assisted by anodically produced gas, and then returns from top parts to bottom parts of the inter-electrode gaps along electrolyte paths. Each electrolyte path extends through horizontal and vertical passages as follows: a vertical passage associated with a cathode and then a horizontal passage in or under a lower part of the cathode, and/or a horizontal passage in or on an upper part of an anode and then a vertical passage associated with the anode. Each horizontal passage extends substantially over the entire horizontal length of a corresponding inter-electrode gap.

BRIEF DESCRIPTION OF THE DRAWINGS

The invention will be further described with reference to the accompanying schematic drawings, in which:

FIG. 4 is a cross-sectional view of a cell including a further embodiment of a cathode according to the invention;

FIGS. 5 to 7 are cross-sectional views of further embodiments of drained-cathode cells according to the invention in which electrolyte circulation takes place around the anodes.

DETAILED DESCRIPTION

Figure 1:
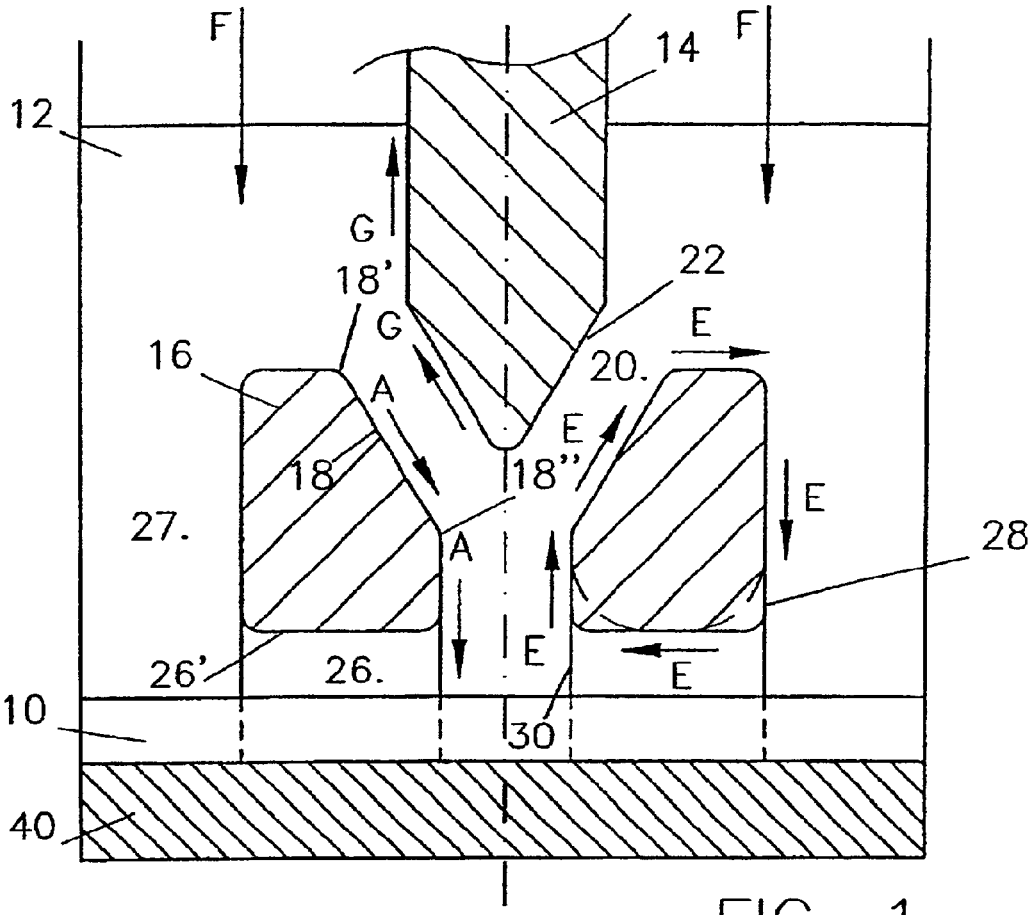
FIG. 1 is a cross-sectional view showing part of a drained-cathode cell according to the invention.

FIG. 1 schematically shows a drained cathode cell for the electrowinning of aluminium 10 in a molten fluoride-containing electrolyte 12 such as cryolite containing dissolved alumina. The cell comprises a plurality of anodes 14 suspended over and spaced apart by sloped inter-electrode gaps 20 from cathode blocks 16. The cell can contain a convenient number of rows of anodes 14 and cathode blocks 16; for simplicity, only one anode 14 and one cathode block 16 are shown.

The cathode blocks 16 have sloping drained cathode surfaces 18 made of or coated with an aluminium-wettable refractory material. For example, the cathode blocks 16 are made of carbon and the aluminium-wettable cathode surface is a coating containing titanium diboride deposited from a slurry as described in U.S. Pat. No. 5,651,874 (de Nora/Sekhar) or WO 98/17842 (Sekhar/Duruz/Liu). The cathode blocks 16 are placed on or secured to a cell bottom 40, by bonding or mechanical means. The cell bottom 40 may also be made of carbon coated with an aluminium-wettable surface containing titanium diboride.

The wettability of the coating may be improved by adding a wetting agent consisting of at least one metal oxide, such as copper, iron or nickel oxide, that reacts during use with molten aluminium to produce aluminium oxide and the metal of the wetting oxide, as disclosed in PCT/IB99/01982 (de Nora/Duruz).

These sloping drained cathode surfaces 18 lead into an arrangement for collecting product aluminium 10 drained from the cathode surfaces 18 onto the cell bottom 40. The anodes 14 have sloping operative anode surfaces 22 facing the sloping drained cathode surfaces 18. These sloping operative anode surfaces 22 assist the upward removal of anodically produced gases, as indicated by arrows G.

The bottom surface of each cathode block 16 is provided with four sidewardly-directed grooves 26' delimiting generally horizontal electrolyte passages 26. Each horizontally sidewardly-directed groove 26' extends from an outer lateral face 28 to a central inner face 30 of cathode block 16 below the bottom end 18" of the sloping cathode surface 18.

These horizontal electrolyte passages 26 co-operate with generally vertical electrolyte passages 27 delimited by the outer lateral faces 28 of adjacent cathode blocks 16 to define an electrolyte return path for the circulation of electrolyte 12 induced by the removal of anodically produced gases along the sloping anode surface 22 in the inter-electrode gaps 20, as indicated by arrow G.

In each inter-electrode gap 20 the electrolyte 12 circulates upwardly, counter to the draining of aluminium down the sloping drained cathode surfaces 18. When the electrolyte 12 reaches outer lateral face 28 of the cathode block 16 after having reached the upper end of the inter-electrode gap 20 at the top 18' of the sloping drained cathode surface 18, it flows down the generally vertical electrolyte passage 27 and is returned to the inner face 30 of the cathode block 16 via the generally horizontal electrolyte passage 26. The electrolyte then circulates from the inner face 30 to the lower end of the inter-electrode gap 20 at the bottom end 18" of the sloping drained cathode surface 18.

This circulation of the electrolyte is indicated by arrows E in the right-hand part of FIG. 1, whereas the draining of the product aluminium is indicated by arrows A in the left-hand part of FIG. 1.

As indicated by arrows F in FIG. 1, the electrolyte 12 is fed with alumina where it circulates near the electrolyte surface, i.e. above the upper part of the inter-electrode gaps 20. Subsequently, alumina-rich electrolyte 12 flows around the cathodes 16 down the generally vertical electrolyte passages 27, to be supplied to the generally horizontal electrolyte passages 26, which supply the alumina-rich electrolyte to the bottom of the inter-electrode gaps 20.

The top of the grooves 26' delimiting the generally horizontal electrolyte passages 26 extend above the level of aluminium that collects as a shallow pool 10 on the cell bottom 40. The aluminium 10 is collected in a reservoir (not shown) external to the arrangement of anodes 14 and cathodes blocks 16, and this reservoir is tapped at regular intervals to maintain the aluminium pool 10 at a desired level. This reservoir can be located in the centre of the cell as disclosed in co-pending application PCT/IB99/00698 (de Nora), or at one end of the cell, inside or outside the cell. The aluminium level is controlled so that aluminium in the pool 10 does not rise to a level approaching the top of the passages 26 where it could obstruct the electrolyte circulation.

Figure 2:
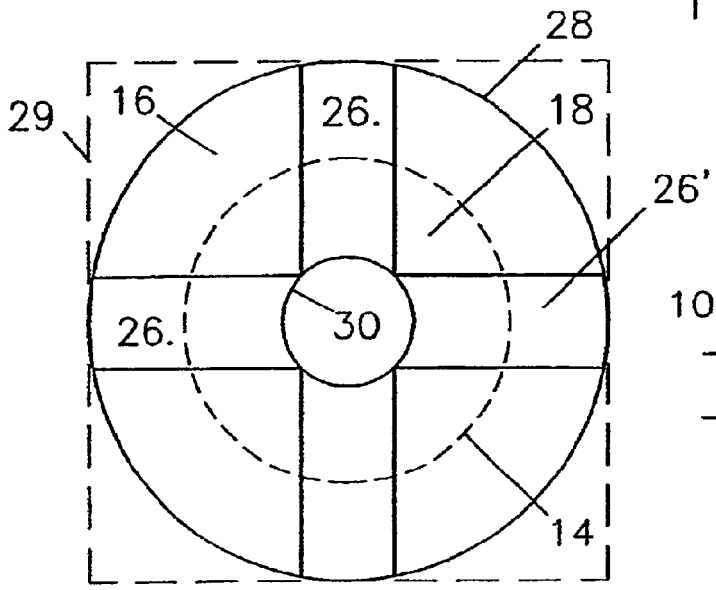
FIG. 2 is a view from underneath one embodiment of a cathode of the cell of FIG. 1.

FIG. 2 shows a generally cylindrical cathode block 16 of FIG. 1 in schematic view from underneath. In this example, four sidewardly-directed grooves 26' forming the generally horizontal electrolyte passages 26 in the underneath of the cathode block 16 are arranged in cruciform configuration, meeting centrally at the inner face 30 which is a cylindrical through-bore. In this embodiment, the sloping drained cathode surfaces 18 and the sloping anode surfaces 22 are generally frustoconical. If required, the passages 26 can be rounded or can flare out at their outer ends where they lead into the generally-cylindrical outer face 28 of cathode block 16.

Figure 2A:
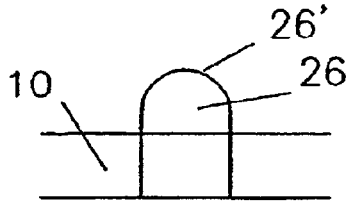
FIG. 2*a* illustrates a detail of FIG. 2.

As shown in FIG. 2*a*, the upper parts of the grooves 26' forming the generally horizontal electrolyte passages 26 above the level of the aluminium pool 10 can be arch-shaped. In an alternative embodiment, the generally horizontal electrolyte passages 26 may be formed by holes in a bottom part of the cathode blocks 16, or the cathode blocks 16 may be suspended, for instance from the anodes 14, so as to leave a gap between cathode blocks 16 and the collected molten aluminium 10 defining a generally horizontal electrolyte passage 26 under the entire bottom surface of the cathode block 16.

FIG. 2 also shows in a dotted line 29 the outline of a cathode block of generally rectangular shape, having the same internal configuration.

FIG. 1 illustrates the generally horizontal electrolyte passage 26 as being of uniform height from one end to the other. However, to improve circulation of the electrolyte 12 and preclude wear, the end parts of the passages 26 could be curved as shown in dotted lines in the right-hand part of FIG. 1. Likewise, the upper face of the cathode block 16 can either be flat, as shown, or rounded.

Figure 3:
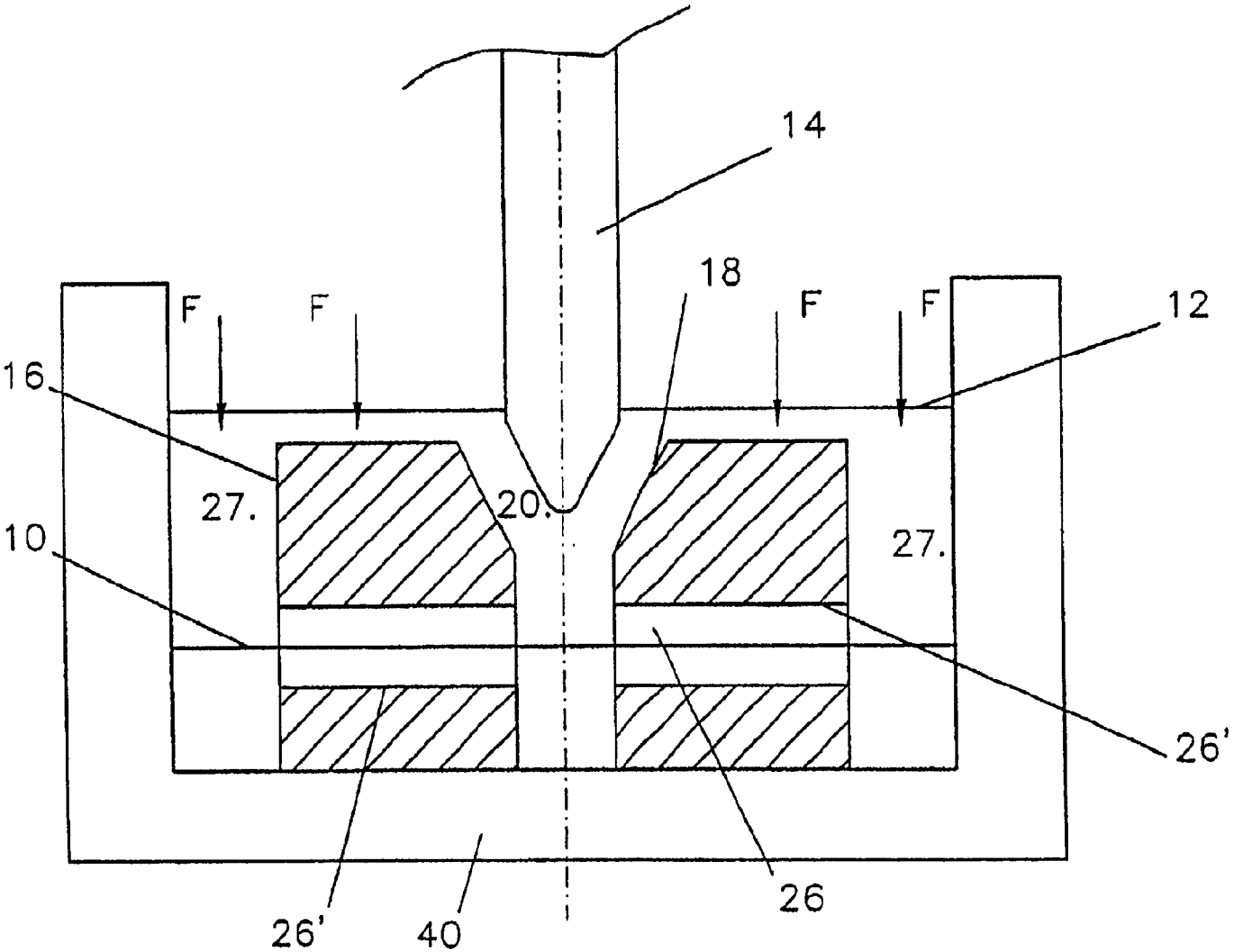
FIG. 3 is a view similar to FIG. 1 showing part of a cell with a modified cathode.

FIG. 3 shows part of a drained-cathode cell according to the invention similar to the cell of FIG. 1, containing one or several rows of cathode blocks 16. In the cell of FIG. 3, the generally horizontal electrolyte passages 26 are located in apertures 26' extending through the bulk of the cathode body 16, spaced above the bottom of the cathode body 16 and hence above the cell bottom 40. The apertures 26' can for example be of circular or oval cross-section, or rectangular with rounded edges. As before, the level of aluminium 10 is maintained about midway up these apertures 26'. In this embodiment, the alumina feed indicated by arrow F is over cathode 16 as well as over vertical passages 27 leading to the generally horizontal passages 26.

The cathode illustrated in FIG. 3 could also be annular with the sloping cathode surfaces 18 distributed around the top of the annulus.

FIG. 4 illustrates an electrolyte circulation, indicated by arrows E, in and around a cathode 16. This electrolyte circulation generally corresponds to an electrolyte circulation which can be obtained by placing a plurality of anode-cathode arrangements 14,16 as individually shown in FIG. 3 side-by-side but spaced apart in a cell.

The cathode 16 shown in FIG. 4 comprises a plurality of cathode surfaces 18 arranged in pairs as truncated V-shapes or inverted V-shapes facing a corresponding number of anodes 14 spaced therefrom by inter-electrode gaps 20.

The cathodes 16 include a series of electrolyte paths 26,27. Each electrolyte path extends through a vertical passage 27 delimited by a vertical aperture between a pair of cathode surfaces 18, from a top to a lower part of a cathode 16, and then through a horizontal passage 26 delimited by a horizontal aperture 26' in the lower part of the cathode.

Figure 6:
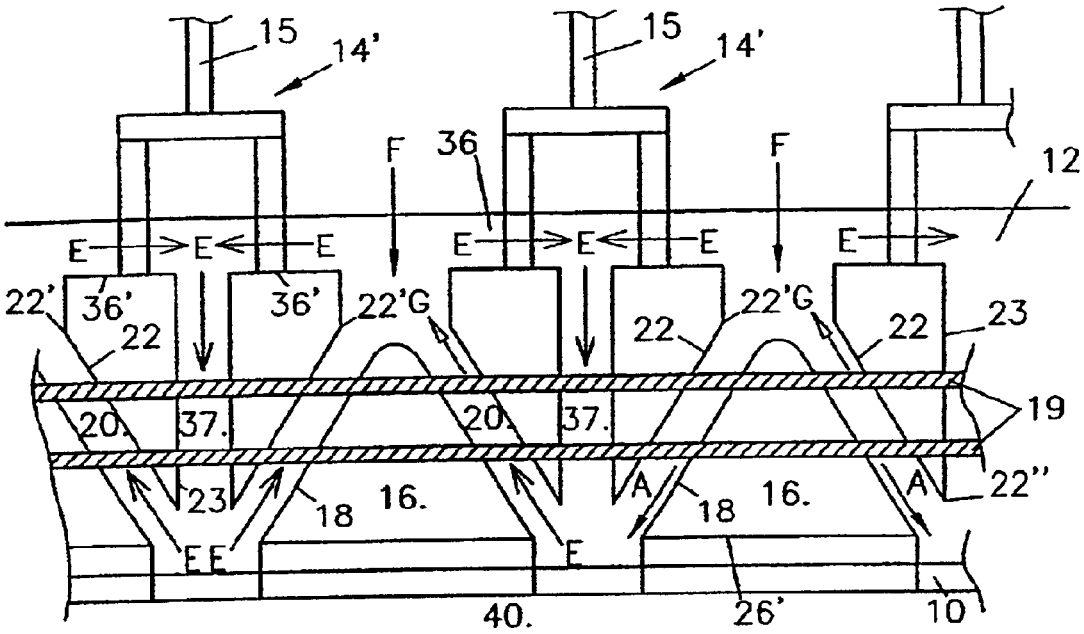
Figure 7:
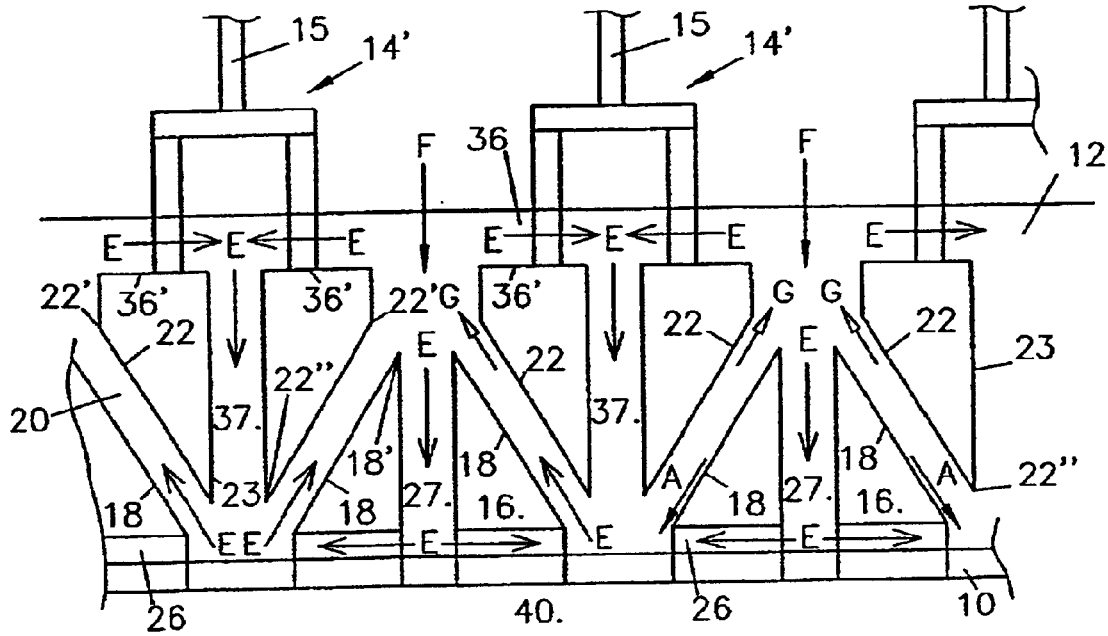

FIGS. 5, 6 and 7 schematically show different anode-cathode arrangement of a drained cathode cell in which an electrolyte circulation takes place around anodes 14,14'. In practice, the anodes will all be the same, but for the purpose of illustration two different anode configurations 14 and 141 are shown.

FIGS. 5 and 6 each show a drained cathode cell for the electrowinning of aluminium 10 in a molten fluoride-containing electrolyte 12 containing dissolved alumina. The cell comprises a plurality of anodes 14,14' suspended over and spaced apart by sloped inter-electrode gaps 20 from cathode blocks 16. The cell can contain a convenient number of rows of anodes 14,14' and cathode blocks 16.

The anode blocks 14,14' have sloping active anode surfaces 22. The anodes may be made of carbonaceous material, in particular impregnated with a boron-containing solution as described in U.S. Pat. No. 5,486,278 (Manganiello/Duruz/Bello) and in EP-B-0874789 (de Nora/Duruz/Berclaz). However, the anodes are preferably oxygen-evolving non-consumable anodes made of non-carbon inert material, in particular of metal or metal-based material, which can be maintained dimensionally stable, as mentioned above.

The sloping active anode surfaces 22 face correspondingly sloped drained cathode surfaces 18 which lead into an arrangement for collecting product aluminium 10 drained from the cathode surfaces 18 onto the cell bottom 40. The sloping active anode surfaces 22 assist the upward removal of anodically produced gases, as indicated by arrows G.

The bottom surface of each cathode block 16 is optionally provided with a recessed groove 26" extending sideways through the cathode block 16 for facilitating movement of product aluminium 10 when tapped at one end of the cell. Such a groove 26", as opposed to the grooves 26' shown in the previous Figures, does not serve for the circulation of electrolyte. Different arrangements for collecting aluminium are suitable, for example as disclosed in U.S. Pat. No. 5,683,559 (de Nora).

The upper part of each anode block 14,14' is associated with a generally horizontal electrolyte passage 36 defining part of an electrolyte return path.

In the left-hand part of FIG. 5, each anode 14 comprises in its upper part a groove or aperture 36' delimiting the generally horizontal electrolyte passage 36. This groove or aperture 36' extends horizontally adjacent the top ends 22' of the sloping active anode surface 22 to a vertical aperture 23 which extends to a bottom part of the anode 14 between the anode surfaces 22 defining a vertical electrolyte path 37.

In the right-hand part of FIG. 5 and in FIG. 6, each anode 14' is provided with an upper face 36' which delimits the generally horizontal electrolyte passage 36. In this case the anodes 14' are suspended from a stem 15 with the entire operative part of the anode 14' immersed in the molten electrolyte 12, leaving a space above the upper face 36' for electrolyte circulation.

Each generally horizontal electrolyte passage 36 is associated with a generally vertical electrolyte passage 37 which is delimited by an aperture 23 extending to a bottom part of the anode 14 between the anode surfaces 22. The generally horizontal and vertical passages 36,37 form an electrolyte return path for circulating electrolyte from the top part of the inter-electrode gap 20 at the top end 22 of the sloping active anode surface 22 to the bottom part of the inter-electrode gap 20 at the bottom end 22" of the sloping active anode surface 22. The electrolyte circulation is induced by the release of anodically produced gases along the sloping anode surface 22 in the inter-electrode gap 20, as indicated by arrows G.

In the inter-electrode gap 20, the electrolyte 12 circulates upwardly, counter to the draining of aluminium down the sloping drained cathode surfaces 18. When the electrolyte 12 reaches the generally horizontal electrolyte passage 36 associated with the anodes 14,14'; it flows along the passage 36 and then down the generally vertical electrolyte passage 37 along aperture 23 from where it is returned to the bottom of the inter-electrode gap 20 at the bottom end 22" of the sloping active anode surface 22.

This circulation of the electrolyte 12 is indicated by arrows E in the left-hand part of FIG. 5, whereas the draining of the product aluminium is indicated by arrows A in the right-hand part of FIG. 5. As indicated by arrows F, in the left-hand part of FIG. 5, alumina is fed between the anodes 14, whereas in the right hand part of FIG. 5 alumina may be fed between and/or above the immersed anodes 14.

In FIG. 6, each cathode 16 is mechanically secured between a pair of adjacent anodes 14' by horizontal electrically non-conductive bars 19 which are secured in the anodes 14' and which extend through the cathodes 16. This configuration allows simultaneous insertion and removal of the anodes 14' and cathodes 16 as well as precise positioning of the anodes 14' over the cathodes 16 permitting operation with a small inter-electrode gap 20.

In FIG. 7, each anode 14' and cathode 16, is respectively associated with a generally horizontal electrolyte passage 36,26 co-operating with a generally vertical electrolyte passage 37,27 defining electrolyte return paths as described above.

During cell operation, alumina dissolved in the electrolyte 12 is electrolysed in the inter-electrode gaps 20 to produce aluminium on the sloped drained cathode surface 18 and gas, for example oxygen, on the active anode surfaces 22. The product aluminium drains down the sloped cathode surfaces 18 into an arrangement for collecting molten aluminium 10, whereas the removal of anodically produced gases along the sloping anode surface 22 in the inter-electrode gap 20, as indicated by arrow G, induces an electrolyte up flow producing the electrolyte circulation indicated by arrows E.

The electrolyte 12 flows up the inter-electrode gap 20 where it is progressively depleted in alumina by the electrolysis which takes place between the facing operative surfaces 18,22 of the anodes/cathodes 14',16. The electrolyte exits the upper part of the interelectrode gap 20 between the top ends 18',22' of the anode/cathode operative surfaces 18,22 and the anodically produced gas is released at the surface of the electrolyte 12. Part of the electrolyte flows around and through the anodes 14' initially along the generally horizontal electrolyte passages 36 then down the passages 37. Another part of the electrolyte flows around and through the cathodes 16, down the passage 27 and then up the inter-electrode gap 20.

As indicated by arrows F, the electrolyte 12 is fed with alumina where it circulates near the electrolyte surface, i.e. above the upper part of the inter-electrode gaps 20 or above the upper faces 361 of the anodes 14'. Subsequently, alumina-rich electrolyte 12 flows down the generally vertical electrolyte passages 27,37 through the anodes 14' and through the cathodes 16 respectively, to be supplied on the one hand directly to bottom ends 22" of the sloping active anode surfaces 22 and on the other hand via the generally horizontal electrolyte passages 26 associated with the cathodes 16, thereby supplying alumina-rich electrolyte to the bottom of the interelectrode gaps 20.

Figure 8:
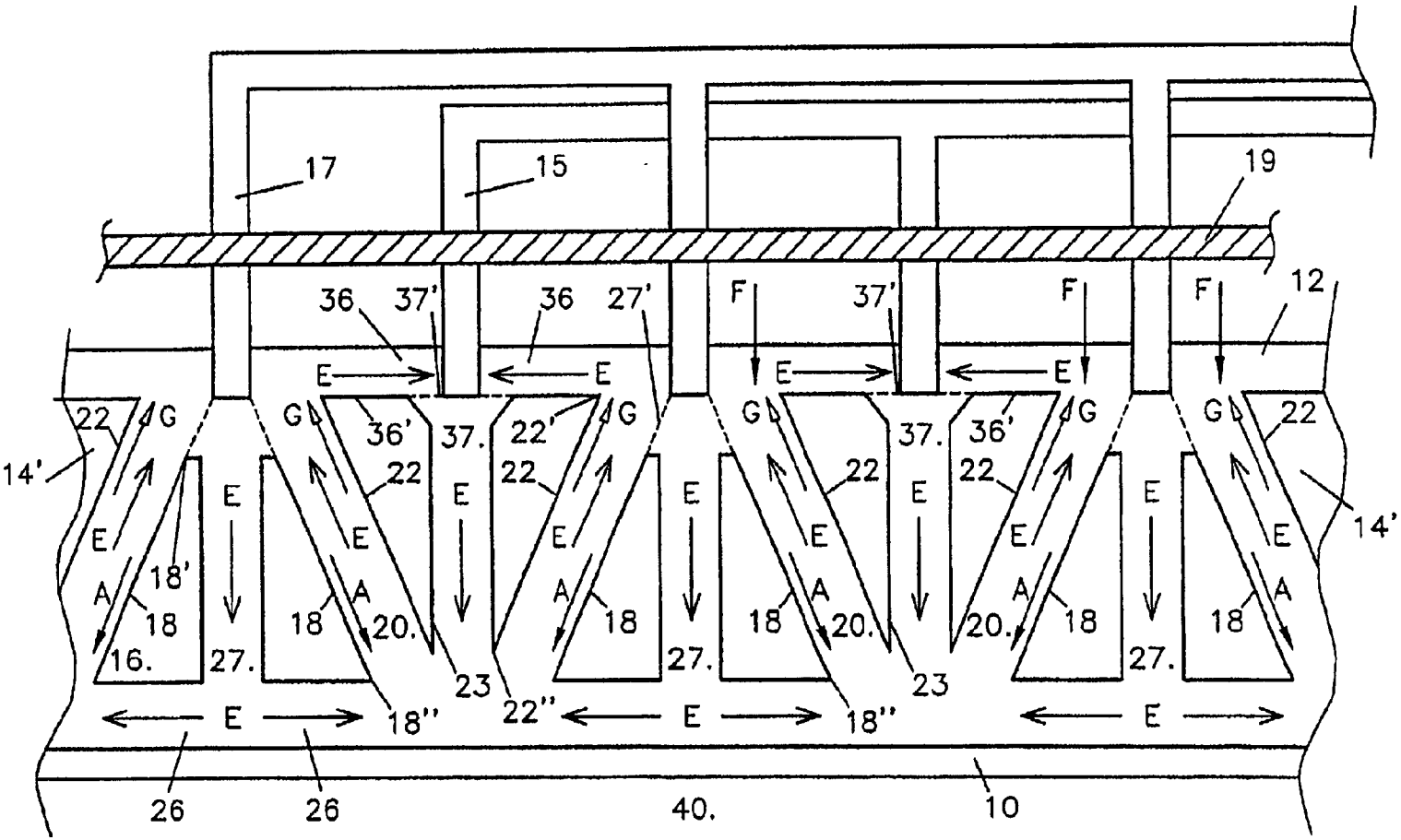
FIG. 8 is a cross-sectional view of a multi-monopolar drained cathode cell according to the invention.

FIG. 8 shows a multi-monopolar drained-cathode cell in which the anodes 14' and cathodes 16 are suspended from above the cell by anode stems 15 and cathode stems 17 which also serve to feed current to anodes 14' and cathodes 16.

Similarly to the cell shown in FIG. 6, the anodes 14' and cathodes 16 are held spaced apart by a horizontal electrically non-conductive bar 19 for their simultaneous insertion and removal and for precise positioning of the active anode surfaces 22 over the drained cathode surfaces 18, thereby permitting operation with a small inter-electrode gap 20. The horizontal electrically nonconductive bar 19 shown in FIG. 8 is secured to the anode stems 15 and cathode stems 17 and is located above the molten electrolyte 12. Hence, the horizontal electrically non-conductive bar 19 shown in FIG. 8 does not need to be resistant to the molten electrolyte 12.

The anodes 14' and cathodes 16 shown in FIG. 8 are each associated with a generally horizontal electrolyte passage 26,36 co-operating with a generally vertical electrolyte passage 27,37 defining electrolyte return paths, as described for FIG. 7.

Furthermore, the cathodes 16 shown in FIG. 8 are spaced above the cell bottom 40 and the product aluminium 10. The space between each cathode 16 and cell bottom 40 defines the generally horizontal passage 26 for the return of alumina-rich molten electrolyte 12 to the bottom end of inter-electrode gap 20.

During cell operation, the anode-cathode arrangement 14',16 permits an electrolyte circulation driven by anodically evolved oxygen as described above. In the cell of FIG. 8, oxygen evolved on the active anode surfaces 22 by electrolysis of dissolved alumina in the inter-electrode gaps 20 escapes towards the surface of the molten electrolyte 12, as indicated by arrows G. The escape of oxygen from under the active anode surfaces 22 generates an electrolyte circulation, as indicated by arrows E, along the inter-electrode gaps 20 and the electrolyte return paths which comprise vertical and horizontal passages 27,26,37,36 associated with anodes 14' and cathodes 16.

The electrolyte 12 circulates upwardly in the sloped inter-electrode gaps 20 and then returns to the bottom of the inter-electrode gaps 20 through the anodes 14' or cathodes 16' from the top of the inter-electrode gaps 20, as follows: part of electrolyte 12 returns through apertures 27' and along the passages 27 extending vertically through the cathodes 16 and then along horizontal passages 26 under the cathodes 16; another part of the electrolyte 12 returns along horizontal passages 36 above anodes 14', and then through apertures 37' and along vertical passages 37 extending through the anodes 14'.

While the invention has been described in conjunction with specific embodiments thereof, it is evident that alternatives, modifications, and variations will be apparent to those skilled in the art.

What is claimed is:

1. A drained-cathode cell for the electrowinning of aluminium from alumina dissolved in a fluoride-containing molten electrolyte, comprising one or more anodes and one or more cathodes, the or each anode and cathode respectively having a sloped V-shaped or inverted V-shaped active anode surface and parallel sloped V-shaped or inverted V-shaped drained cathode surface facing one another and spaced apart by two sloped inter-electrode gaps, the cell further comprising vertical and horizontal passages for guiding an electrolyte circulation from a top part to a bottom part of each inter-electrode gap, said passages being delimited by surfaces of the anodes and/or cathodes and comprising:

a vertical passage that extends from a top to a lower part of a cathode and leads to a horizontal passage that extends in or under the lower part of the cathode, and/or a horizontal passage that extends in or on an upper part of an anode and leads to a vertical passage that from the upper to a bottom part of the anode, each horizontal passage extending stibstantially over the entire horizonta; length of a corresponding inter-electrode gap, the cell being so arranged that during use the electrolyte circulates upwardly in the sloped inter-electrode gaps assisted by anodically produced gas and then returns via said vertical and horizontal passages from the top part to the bottom part of each inter-electrode gap.

2. The cell of claim 1, wherein each horizontal passage is formed by an aperture extending through a cathode or an anode.

3. The cell of claim 1, wherein each horizontal passage is delimited by an external upper face of an anode or an external lower face of a cathode.

4. The cell of claim 1, wherein the or each cathode is associated with an electrolyte path.

5. The cell of claim 4 wherein the electrolyte path extends through a vertical passage in the middle of an inverted V-shaped cathode surface from the top to the lower part of the or each cathode.

6. The cell of claim 4, wherein the electrolyte path extends through a vertical passage extending froui adjacent a top part of a V-shaped cathode surface to the lower part of the or each cathode.

7. The cell of claim 1, wherein the or each anode is associated with an electrolyte path.

8. The cell of claim 7, wherein the electrolyte path extends through a vertical passage from the upper part to the bottom part of the or each anode in the middle of a V-shaped anode surface.

9. The cell of claim 7, wherein the electrolyte path extends through a vertical passage from the upper part of the or each anode to adjacent a bottom part of an inverted V-shaped anode surface.

10. The cell of claim 1, wherein the or each anode and cathode are each associated with an electrolyte path.

11. The cell of claim 1, wherein the sloped drained cathode surfaces lead down into an arrangement for collecting product aluminium.

12. The cell of claim 1, wherein the or each cathode is connected to at least one anode by connection means made of materials of high electrical and mechanical resistance maintaining the inter-electrode gaps substantially constant, the or each cathode being removable and insertable into the cell with said at least one anode to which it is connected.

13. The cell of claim 12, wherein the or each cathode is mechanically secured between a pair of adjacent anodes by at least one horizontal electrically non-conductive bar or rod which is secured in the pair of adjacent anodes and which extends though the cathode.

14. The cell of claim 13, wherein said at least one electrically non-conductive bar or rod extends through a plurality of cathodes.

15. The cell of clairt 12, wherein the or each cathode is suspended from at least one anode.

16. The cell of claim 1, wherein the drained cathode surfaces have an aluminium-wettable coating.

17. The cell of claim 16, wherein the drained cathode surfaces are made dimensionally stable by a slurry-applied coating of aluminium-wettable refractory material.

18. The cell, of claim 1, wherein the molten electrolyte consists essentially of cryolite with an excess of $AlF_3$ that corresponds to about 25 to 35 weight % of the electrolyte.

19. The cell of claim 1, wherein the electrolyte has a temperature from 780° to 880° C., in particular from 820° to 860° C.

20. A cathode of a cell for the electrowinning of aluminium from alumina dissolved in a fluoride-containing molten electrolyte as defined in claim 1, the cathode comprising one or more inverted V-shaped sloped drained cathode surfaces facing during; use one or more anodes and spaced therefrom by inter-electrode gaps, the cathode corn risin surfaces that delimit during use passages for guiding an electrolyte circulation from a top part to a bottom part of the inter-electrode gaps, said passages comprising a vertical passage that extends from a top to a lower part of a cathode and leads to a horizontal passage that extends in or under the lower part of the cathode, the horizontal passage extending substantially over the entire horizontal length of the corresponding inverted V-shaped cathode surface.

21. An anode of a cell for the electrowinning of aluminium from alumina dissolved in a fluoride-containing molten electrolyte as defined in claim 1, the anode comprising a V-shaped sloped active anode surface facing during use a correspondingly sloped drained cathode surface and spaced therefrom by inter-electrode gaps, the anode corn risin surfaces that delimit dunn use nsa es for guiding an electrolyte circulation from a top part to a bottom part of the inter-electrode gaps, said passages comprising a horizontal passage that extends in or on an upper part of the anode and leads to a vertical passage that extends from the upper part to a bottom part the anode, the horizontal passage extending substantially over the entire horizontal length of the V-shaped anode surface.

22. A method of electrowinning aluminium in a cell which contains dissolved alumina in a fluoride-containing molten electrolyte, the method comprising: electrolysing disBolved alumina in a sloped inter-electrode gaps, thereby producing aluminium on the a sloped drained cathode surface(s) of a cathode and gas on the a active anode surface(s) of an anode; assisting electrolyte circulation upwardly in the sloped inter-electrode gap by the upward removal of anodically produced gas, returning the electrolyte from a top part to a bottom part of the inter-electrode gap along:

a vertical passage that extends from a top to a lower part of the cathode and then leads to a horizontal passage that extends in or under the lower part of the cathode; and/or a horizontal passage that extends in or on an upper part of the anode and then leads to a vertical passage that extendin from the upper to a bottom art of the anode, each horizontal passage extending substantially over the entire horizontal length of the inter-electrode gap;

and replenishing returning alumina-depleted electrolyte with alumina in said electrolyte paths.

23. The method of claim 22, comprising replenishing alumina-depleted electrolyte with alumina adjacent to the top parts of the inter-electrode gaps.

24. The method of claim 22, wherein the or each anode is associated with an electrolyte path, alumina being fed from above the upper part of the or each anode where it is dissolved in the electrolyte and circulated along the electrolyte path to a lower part of the inter-electrode gap.

25. The method of claim 22, wherein the or each cathode is associated with a electrolyte path, alumina being fed from above the top part of the or each cathode where it is dissolved in the electrolyte and circulated along the electrolyte path to a lower part of the inter-electrode gap.

26. The method of claim 22, wherein the anode(s) and the cathode(s) are each associated with an electrolyte path, one part of the electrolyte being circulated along each electrolyte path associated with a respective anode, another part of the electrolyte being circulated along each electrolyte path associated with a respective cathode.

27. A drained-cathode cell for the electrowinning of aluminium from alumina dissolved in a fluoride-containing molten electrolyte, comprising a series of anodes and one or more cathodes, the anodes and the cathode(s) respectively having sloped active anode surfaces and parallel sloped drained cathode surfaces facing one another and spaced apart by sloped inter-electrode gaps, the cell further comprising horizontal and vertical passages for guiding an electrolyte circulation from a top part to a bottom part of each inter-electrode gap, said passages being delimited by surfaces of the anodes and/or cathodes and comprising:

a vertical passage associated with a cathode and then a horizontal passage, in or under a lower part of the cathode, and/or a horizontal passage in or on an upper part of an anode and then a vertical passage associated with the anode, each horizontal passage extending substantially over the entire horizontal length of a corresponding inter-electrode gap, the cell being so arranged that during use the electrolyte circulates upwardly in the sloped inter-electrode gaps assisted by anodically produced gas and then returns via said vertical and horizontal passages from the top part to the bottom, part of each inter-electrode gap.

* * * * *